US007766053B2

(12) United States Patent
Barratte

(10) Patent No.: US 7,766,053 B2
(45) Date of Patent: Aug. 3, 2010

(54) MULTI-LAYER PAPERMAKER'S FORMING FABRIC WITH ALTERNATING PAIRED AND SINGLE TOP CMD YARNS

(75) Inventor: Christine Barratte, Saint-Claude (FR)

(73) Assignee: Weavexx Corporation, Wake Forest, NC (US)

( * ) Notice: Subject to any disclaimer, the term of this patent is extended or adjusted under 35 U.S.C. 154(b) by 0 days.

(21) Appl. No.: 12/409,814

(22) Filed: Mar. 24, 2009

(65) Prior Publication Data

US 2010/0108175 A1 May 6, 2010

Related U.S. Application Data

(60) Provisional application No. 61/110,102, filed on Oct. 31, 2008.

(51) Int. Cl.

| | |
|---|---|
| ***D03D 3/04*** | (2006.01) |
| ***D21F 1/10*** | (2006.01) |
| ***D21F 7/08*** | (2006.01) |
| *D03D 25/00* | (2006.01) |

(52) U.S. Cl. ..... 139/383 A; 139/383 R; 139/383 AA; 162/358.2

(58) Field of Classification Search ..... 139/383 R, 139/383 A, 383 AA, 408, 411, 412, 413, 139/414; 162/348, 358.1, 358.2, 900, 902, 162/903, 904

See application file for complete search history.

(56) References Cited

U.S. PATENT DOCUMENTS 2,172,430 A 9/1939 Barrell
2,554,034 A 5/1951 Koester et al.
3,094,149 A 6/1963 Keily
3,325,909 A 6/1967 Clark
3,851,681 A * 12/1974 Egan ..... 139/420 R
4,093,512 A 6/1978 Fleischer (Continued)

FOREIGN PATENT DOCUMENTS

DE 454 092 12/1927

(Continued)

OTHER PUBLICATIONS

Partial International Search for PCT/US2009/000093 mailed May 15, 2009.

(Continued)

*Primary Examiner*—Bobby H Muromoto, Jr.
(74) *Attorney, Agent, or Firm*—Myers Bigel Sibley & Sajovec

(57) ABSTRACT

A papermaker's fabric comprises a series of repeat units. Each of the repeat units comprises: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of CMD stitching yarns interwoven with the top and bottom CMD yarns to bind the top and bottom fabric layers together. The stitching yarns are arranged in pairs. The top CMD yarns are arranged in an alternating pattern in which first (a) a single top CMD yarn is positioned between adjacent pairs of stitching yarns, then (b) two top CMD yarns are positioned between adjacent pairs of stitching yarns.

25 Claims, 9 Drawing Sheets

U.S. PATENT DOCUMENTS 4,182,381 A 1/1980 Gisbourne
4,231,401 A * 11/1980 Matuska ..... 139/383 A
4,244,543 A 1/1981 Ericson
4,289,173 A 9/1981 Miller
4,290,209 A 9/1981 Buchanan et al.
4,408,637 A * 10/1983 Karm ..... 139/425 A
4,414,263 A 11/1983 Miller et al.
4,438,788 A 3/1984 Harwood
4,452,284 A 6/1984 Eckstein et al.
4,453,573 A 6/1984 Thompson
4,501,303 A 2/1985 Osterberg
4,515,853 A 5/1985 Borel
4,529,013 A 7/1985 Miller
4,564,052 A 1/1986 Borel
4,564,551 A 1/1986 Best
4,592,395 A 6/1986 Borel
4,592,396 A 6/1986 Borel et al.
4,605,585 A 8/1986 Johansson
4,611,639 A 9/1986 Bugge
4,621,663 A 11/1986 Malmendier
4,633,596 A 1/1987 Josef
4,636,426 A 1/1987 Fleischer
4,642,261 A 2/1987 Fearnhead
4,676,278 A 6/1987 Dutt
4,705,601 A 11/1987 Chiu
4,709,732 A 12/1987 Kinnunen
4,729,412 A 3/1988 Bugge
4,731,281 A 3/1988 Fleischer et al.
4,739,803 A 4/1988 Borel
4,755,420 A 7/1988 Baker et al.
4,759,975 A 7/1988 Sutherland et al.
4,815,499 A 3/1989 Johnson
4,815,503 A 3/1989 Borel
4,909,284 A 3/1990 Kositzke
RE33,195 E 4/1990 McDonald et al.
4,934,414 A 6/1990 Borel
4,941,514 A 7/1990 Taipale
4,942,077 A 7/1990 Wendt et al.
4,945,952 A 8/1990 Vöhringer
4,967,805 A 11/1990 Chiu et al.
4,987,929 A 1/1991 Wilson
4,989,647 A 2/1991 Marchand
4,989,648 A 2/1991 Tate et al.
4,998,568 A 3/1991 Vohringer
4,998,569 A 3/1991 Tate
5,022,441 A 6/1991 Tate et al.
5,025,839 A 6/1991 Wright
5,066,532 A * 11/1991 Gaisser ..... 428/137
5,067,526 A 11/1991 Herring
5,074,339 A 12/1991 Vohringer
5,084,326 A 1/1992 Vohringer
5,092,372 A 3/1992 Fitzka et al.
5,101,866 A 4/1992 Quigley
5,116,478 A 5/1992 Tate et al.
5,152,326 A 10/1992 Vohringer
5,158,118 A 10/1992 Tate et al.
5,219,004 A 6/1993 Chiu
5,228,482 A 7/1993 Fleischer
5,254,398 A * 10/1993 Gaisser ..... 442/195
5,277,967 A 1/1994 Zehle et al.
5,358,014 A 10/1994 Kovar
5,421,374 A 6/1995 Wright
5,421,375 A 6/1995 Praetzel
5,429,686 A 7/1995 Chiu et al.
5,431,786 A * 7/1995 Rasch et al. ..... 162/348
5,437,315 A 8/1995 Ward
5,449,026 A 9/1995 Lee
5,454,405 A 10/1995 Hawes
5,456,293 A 10/1995 Ostermayer et al.
5,465,764 A 11/1995 Eschmann et al.
5,482,567 A 1/1996 Barreto
5,487,414 A 1/1996 Kuji et al.
5,503,196 A 4/1996 Josef et al.
5,518,042 A 5/1996 Wilson
5,520,225 A 5/1996 Quigley et al.
5,542,455 A 8/1996 Ostermayer et al.
5,555,917 A 9/1996 Quigley
5,564,475 A 10/1996 Wright
5,641,001 A 6/1997 Wilson
5,651,394 A 7/1997 Marchand
5,709,250 A 1/1998 Ward et al.
RE35,777 E 4/1998 Givin
5,746,257 A 5/1998 Fry
5,826,627 A 10/1998 Seabrook et al.
5,857,498 A 1/1999 Barreto et al.
5,881,764 A 3/1999 Ward
5,894,867 A 4/1999 Ward et al.
5,899,240 A 5/1999 Wilson
5,937,914 A 8/1999 Wilson
5,967,195 A 10/1999 Ward
5,983,953 A 11/1999 Wilson
6,073,661 A 6/2000 Wilson
6,112,774 A * 9/2000 Wilson ..... 139/383 A
6,123,116 A 9/2000 Ward et al.
6,145,550 A 11/2000 Ward
6,148,869 A 11/2000 Quigley
6,158,478 A 12/2000 Lee et al.
6,179,965 B1 1/2001 Cunnane et al.
6,202,705 B1 3/2001 Johnson et al.
6,207,598 B1 3/2001 Lee et al.
6,227,255 B1 5/2001 Osterberg et al.
6,237,644 B1 5/2001 Hay et al.
6,240,973 B1 6/2001 Stone et al.
6,244,306 B1 6/2001 Troughton
6,253,796 B1 7/2001 Wilson et al.
6,276,402 B1 8/2001 Herring
6,379,506 B1 4/2002 Wilson et al.
6,581,645 B1 6/2003 Johnson et al.
6,585,006 B1 7/2003 Wilson et al.
6,786,242 B2 * 9/2004 Salway et al. ..... 139/383 A
6,837,277 B2 * 1/2005 Troughton et al. ..... 139/383 A
6,899,143 B2 5/2005 Rougvie et al.
6,904,942 B2 * 6/2005 Odenthal ..... 139/383 A
7,001,489 B2 2/2006 Taipale et al.
7,008,512 B2 * 3/2006 Rougvie et al. ..... 162/348
7,059,357 B2 6/2006 Ward
7,108,020 B2 9/2006 Stone
7,445,032 B2 * 11/2008 Barrett et al. ..... 139/383 A
2003/0010393 A1 1/2003 Kuji
2004/0079434 A1 4/2004 Martin et al.
2004/0102118 A1 5/2004 Hay et al.
2004/0149343 A1 * 8/2004 Troughton et al. ..... 139/383 R
2005/0268981 A1 12/2005 Barratte
2006/0169346 A1 8/2006 Fahrer et al.
2009/0183795 A1 7/2009 Ward et al.

FOREIGN PATENT DOCUMENTS

DE 3318960 A1 11/1984
DE 33 29 740 A1 3/1985
DE 10 2005 041 042 A1 3/2007
EP 0 048 962 B2 9/1981
EP 0 158 710 A1 10/1984
EP 0 185 177 B1 10/1985
EP 0 224 276 B1 12/1986
EP 0 264 881 B1 10/1987
EP 0 269 070 B1 11/1987
EP 0 284 575 B1 2/1988
EP 0 283 181 B1 3/1988
EP 0 350 673 B1 6/1989
EP 0 408 849 A2 5/1990
EP 0 408 849 A3 5/1990
EP 0 672 782 B1 3/1995
EP 0 794 283 A1 9/1997

| | | | |
|---|---|---|---|
| EP | 1 630 283 | A1 | 3/2006 |
| EP | 1 849 912 | A2 | 10/2007 |
| FR | 2 597 123 | | 4/1986 |
| GB | 2157328 | A | 10/1985 |
| GB | 2245006 | A | 2/1991 |
| JP | 8-158285 | | 12/1994 |
| WO | WO 86/00099 | A1 | 1/1986 |
| WO | WO 89/09848 | A1 | 4/1989 |
| WO | WO 03/010304 | A2 | 11/1992 |
| WO | WO 99/61698 | A1 | 12/1999 |
| WO | WO 02/00096 | A2 | 1/2002 |
| WO | WO 03/093573 | A1 | 11/2003 |
| WO | WO 2005/017254 | A1 | 2/2005 |
| WO | WO 2006/015377 2 | | 2/2006 |

OTHER PUBLICATIONS

International Search Report for PCT/US2004/008311.

International Search Report for PCT Application No. PCT/US97/18629.

Rule 132 Declaration of Robert G. Wilson (Jun. 26, 1997).

Warren, C.A., "The Importance of Yarn Properties in Wet-End Wire Construction," Seminar, The Theory of Water Removal, Dec. 12, 1979.

European Search Report corresponding to application No. EP 05002306.8, dated Oct. 18, 2005.

International Search Report and Written Opinion of the International Searching Authority of International Application No. PCT/US2007/022434 (12 pages) (Feb. 8, 2008).

The International Search Report and The Written Opinion for PCT/US2009/062020 dated Feb. 4, 2010.

* cited by examiner

MULTI-LAYER PAPERMAKER'S FORMING FABRIC WITH ALTERNATING PAIRED AND SINGLE TOP CMD YARNS

RELATED APPLICATION

This application claims priority from Parent Provisional Application No. 61/110,102, filed Oct. 31, 2008, the disclosure of which is hereby incorporated herein in its entirety.

FIELD OF THE INVENTION

This application is directed generally to papermaking, and more specifically to fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run that operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is enhanced by the presence of a "batt" layer of the press felt. The paper is then transferred to a dryer section for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaking surface of the fabric is the top of the fabric and the machine side surface of the fabric is the bottom of the fabric.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are now commercially available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. Nos. 5,437,315 and 5,967,195 to Ward, and U.S. Pat. No. 6,745,797 to Troughton.

Fabrics designers are constantly looking for designs that can provide a different balance of performance properties. For example, in some fabrics, high degrees of fiber support and permeability are quite desirable. As such, it may be useful to provide a fabric with strong performance in these areas that is also relatively easy and/or inexpensive to weave.

SUMMARY OF THE INVENTION

As a first aspect, embodiments of the present invention are directed to a papermaker's fabric comprising a series of repeat units. Each of the repeat units comprises: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of CMD stitching yarns interwoven with the top and bottom CMD yarns to bind the top and bottom fabric layers together. The stitching yarns are arranged in pairs. The top CMD yarns are arranged in an alternating pattern in which first (a) a single top CMD yarn is positioned between adjacent pairs of stitching yarns, then (b) two top CMD yarns are positioned between adjacent pairs of stitching yarns.

As a second aspect, embodiments of the present invention are directed to a papermaker's fabric comprising a series of repeat units, each of the repeat units comprising: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of CMD stitching yarns interwoven with the top and bottom CMD yarns to bind the top and bottom fabric layers together. The stitching yarns are arranged in pairs. The top CMD yarns are arranged in an alternating pattern in which first (a) a single top CMD yarn is positioned between adjacent pairs of stitching yarns, then (b) two top CMD yarns are positioned between adjacent pairs of stitching yarns. The top MD yarns, the top CMD yarns, and portions of the stitching yarns interweave to form a plain weave papermaking surface on the top fabric layer. The bottom CMD yarns form floats under the bottom MD yarns.

As a third aspect, embodiments of the present invention are directed to a papermaker's fabric comprising a series of repeat units, each of the repeat units comprising: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of CMD stitching yarns interwoven with the top and bottom CMD yarns to bind the top and bottom fabric layers together. The stitching yarns are arranged in pairs. The top CMD yarns are arranged in an alternating pattern in which first (a) a single top CMD yarn is positioned between adjacent pairs of stitching yarns, then (b) two top CMD yarns are positioned between adjacent pairs of stitching yarns. The top MD yarns, the top CMD yarns, and portions of the stitching yarns interweave to form a plain weave papermaking surface on the top fabric layer. The bottom CMD yarns form knuckles under the bottom MD yarns.

As a fourth aspect, embodiments of the present invention are directed to a papermaker's fabric comprising a series of repeat units, each of the repeat units comprising: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of CMD stitching yarns interwoven with the top and bottom CMD yarns to bind the top and bottom fabric layers together. The stitching yarns are arranged in pairs. The top CMD yarns are arranged in an alternating pattern in which first (a) a single top CMD yarn is positioned between adjacent pairs of stitching yarns, then (b) two top CMD yarns are positioned between adjacent pairs of stitching yarns. The ratio of top CMD yarns and stitching yarn pairs to bottom CMD yarns is 5:2.

As s fifth aspect, embodiments of the present invention are directed to a papermaker's fabric comprising a series of repeat units, each of the repeat units comprising: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of CMD stitching yarns interwoven with the top and bottom CMD yarns to bind the top and bottom fabric layers together. The stitching yarns are arranged in pairs, and the ratio of top CMD yarns and stitching yarn pairs to bottom CMD yarns is 5:2.

DETAILED DESCRIPTION OF EMBODIMENTS OF THE INVENTION

Figure 1:
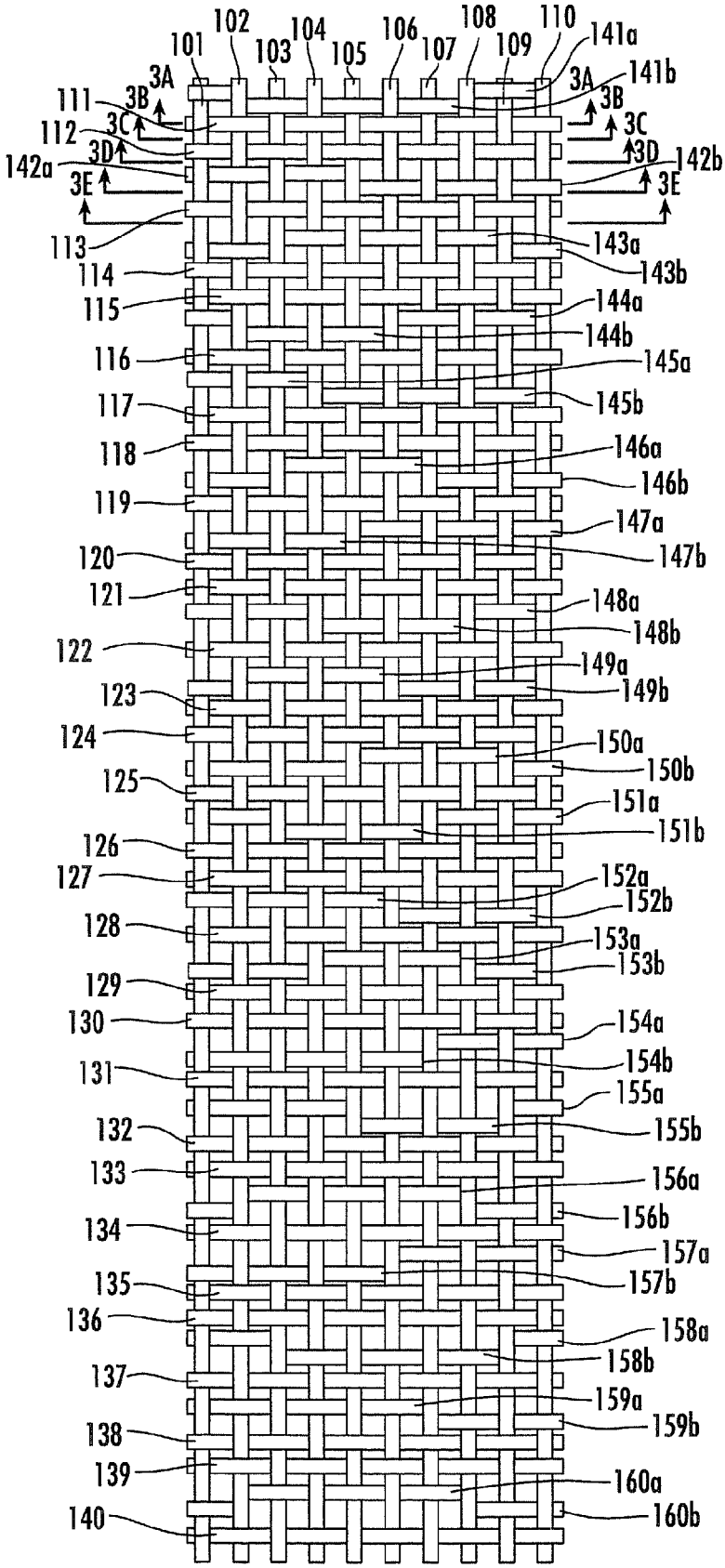
FIG. 1 is a top view of the top layer of a repeat unit of a fabric according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Although the figures below only show single repeat units of the fabrics illustrated therein, those of skill in the art will appreciate that in commercial applications the repeat units shown in the figures would be repeated many times, in both the machine and cross machine directions, to form a large fabric suitable for use on a papermaking machine.

Turning now to FIGS. 1-3B, a repeat unit of a forming fabric according to embodiments of the present invention, designated broadly at 100, is illustrated therein. The repeat unit 100 includes ten top yarns 101-110, thirty top CMD yarns 111-140, ten bottom MD yarns 161-170, twenty bottom CMD yarns 171-190, and twenty pairs of stitching yarns 141*a*, 141*b*-160*a*, 160*b*. The interweaving of these yarns is described below.

Turning first to FIG. 1, the top surface of the fabric 100 is shown therein. The top CMD yarns 111-140 are arranged in an alternating pattern in which two top CMD yarns are positioned between pairs of stitching yarns, then a single top CMD yarn is positioned between pairs of stitching yarns. As exemplified in FIG. 1, top CMD yarns 111 and 112 are positioned between stitching yarn pairs 141*a*, 141*b* and 142*a*, 142*b*, then top CMD yarn 113 is positioned between stitching yarn pairs 142*a*, 142*b* and 143*a*, 143*b*. This pattern of "stitching yarn pair/two top CMD yarns/stitching yarn pair/one top CMD yarn" continues throughout the repeat unit.

Each of the top CMD yarns 111-140 interweaves with the top MD yarns in an "over 1/under 1" sequence. When two top CMD yarns are positioned between a pair of stitching yarns, they pass over alternating top MD yarns. This pattern is shown in FIGS. 3B and 3C, wherein top CMD yarn 111 is shown passing over top MD yarns 102, 104, 106, 108 and 110, whereas top CMD yarn 112 is shown passing over top MD yarns 101, 103, 105, 107 and 109. When a single top CMD is positioned between two stitching yarn pairs, it passes over the same top MD yarns as the adjacent top CMD yarns on either side. As shown in FIG. 3E, top CMD yarn 113 passes over top MD yarns 101, 103, 105, 107 and 109, just as top CMD yarns 112 and 114 do.

Figure 3A:
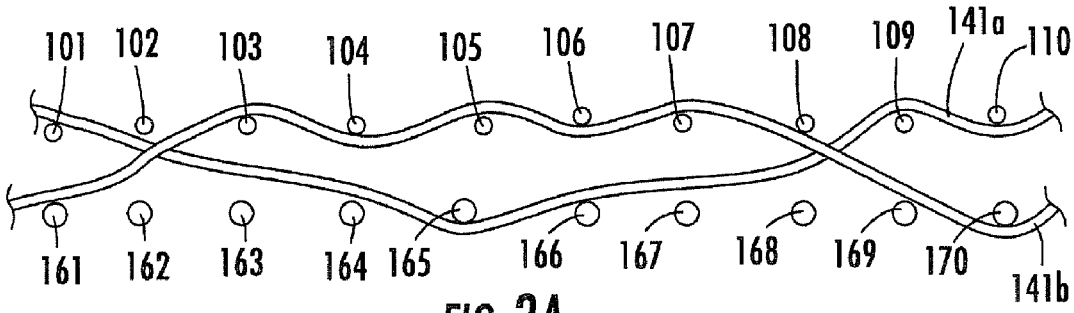
FIGS. 3A-3E are section views taken along lines 3A-3A through 3E-3E, respectively, of the fabric of FIG. 1 showing typical CMD yarns.
Figure 3B:
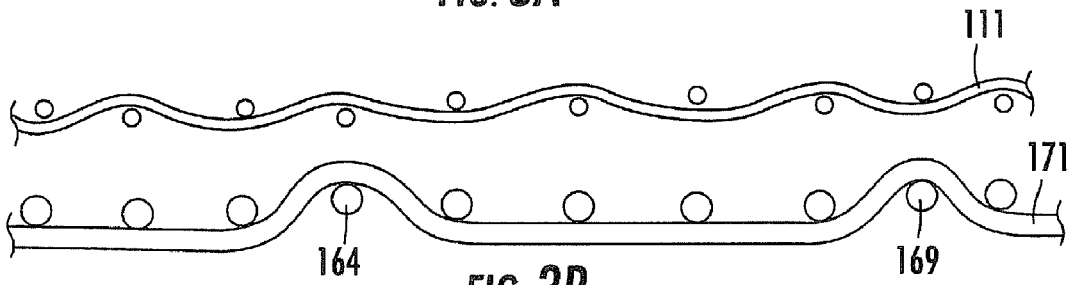
Figure 3C:
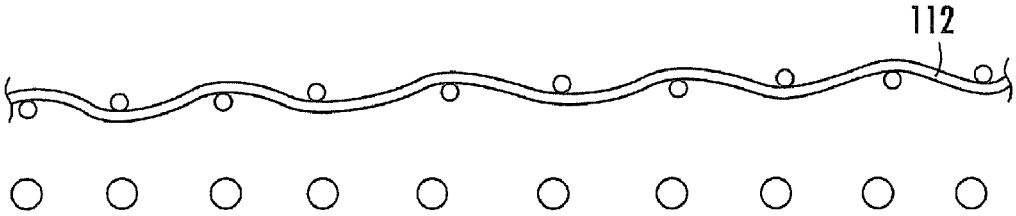
Figure 3D:
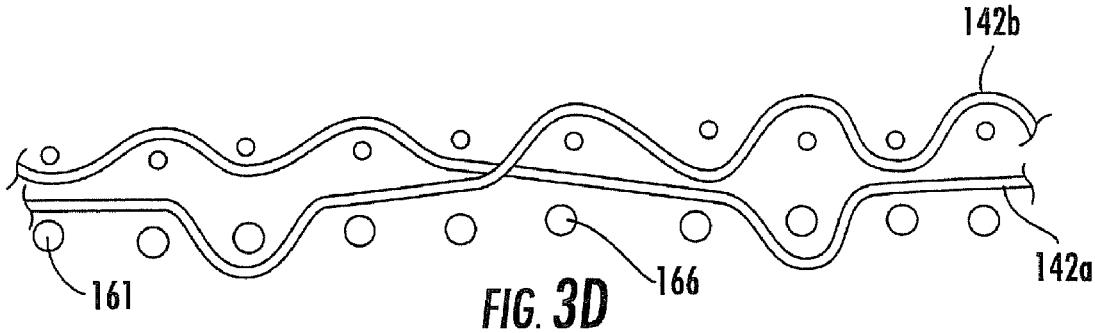
Figure 3E:
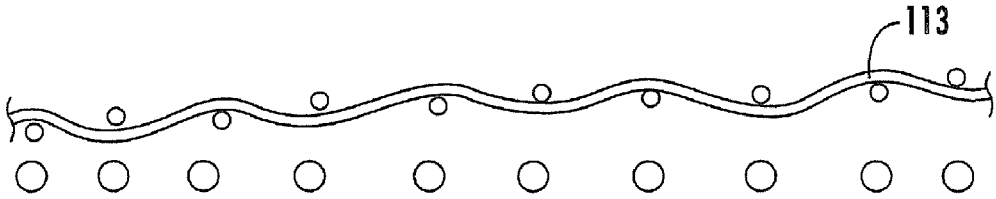

As can be seen in FIGS. 1, 3A and 3D, corresponding pairs of stitching yarns interweave with the top MD yarns and bottom MD yarns in the following pattern. Each of the stitching yarns of the repeat unit can be subdivided into two portions: a fiber support portion which interweaves with the top MD yarns, and a binding portion which passes below the top MD yarns and, in the illustrated embodiment, interweaves with a bottom MD yarn. These are separated at "transitional" top MD yarns, below which one stitching yarn of a pair crosses the other stitching yarn of the pair. The stitching yarns of each pair are interwoven relative to one another such that the fiber support portion of one yarn of the pair is positioned above the binding portion of the other yarn of the pair. The fiber support portion of one stitching yarn of each pair interweaves in an alternating fashion with three top MD yarns (alternately passing over two odd-numbered top MD yarns and under one even-numbered top MD yarn), and the fiber support portion of the other yarn of the pair passes over the other two odd-numbered top MD yarns of the repeat unit while passing below the odd-numbered top MD yarn positioned between those two MD yarns. Both of the stitching yarns pass below the transitional top MD yarns. Thus, together the stitching yarns of each pair pass over five top MD yarns and under five top MD yarns in an "over 1/under 1" pattern similar to that of the top CMD yarns.

In its fiber support portion, each stitching yarn 141*a*, 141*b*-160*a*, 160*b* passes over top MD yarns that the adjacent top CMD yarns pass beneath and under the top MD yarns that the adjacent top CMD yarns pass over. For example, and as shown in FIGS. 3A and 3B, the fiber support portion of stitching yarn 141*a* passes over top MD yarns 109 and 101 while passing under top MD yarn 110, and stitching yarn 141*b* passes over top MD yarns 103, 105 and 107 while passing below top MD yarns 104 and 106. Both stitching yarns 141*a*, 141*b* pass below the transitional top MD yarns 102, 108. As discussed above, adjacent top CMD yarn 111 passes over top MD yarns 102, 104, 106, 108 and 110. The remaining stitching yarn pairs weave in a similar manner, although they may be offset from adjacent stitching yarn pairs by one or more top MD yarns. In this manner, the stitching yarns 141*a*, 141*b*-160*a*, 160*b* and the top CMD yarns 111-140 form a plain weave pattern with the top MD yarns 101-110 (see FIG. 1).

Figure 2:
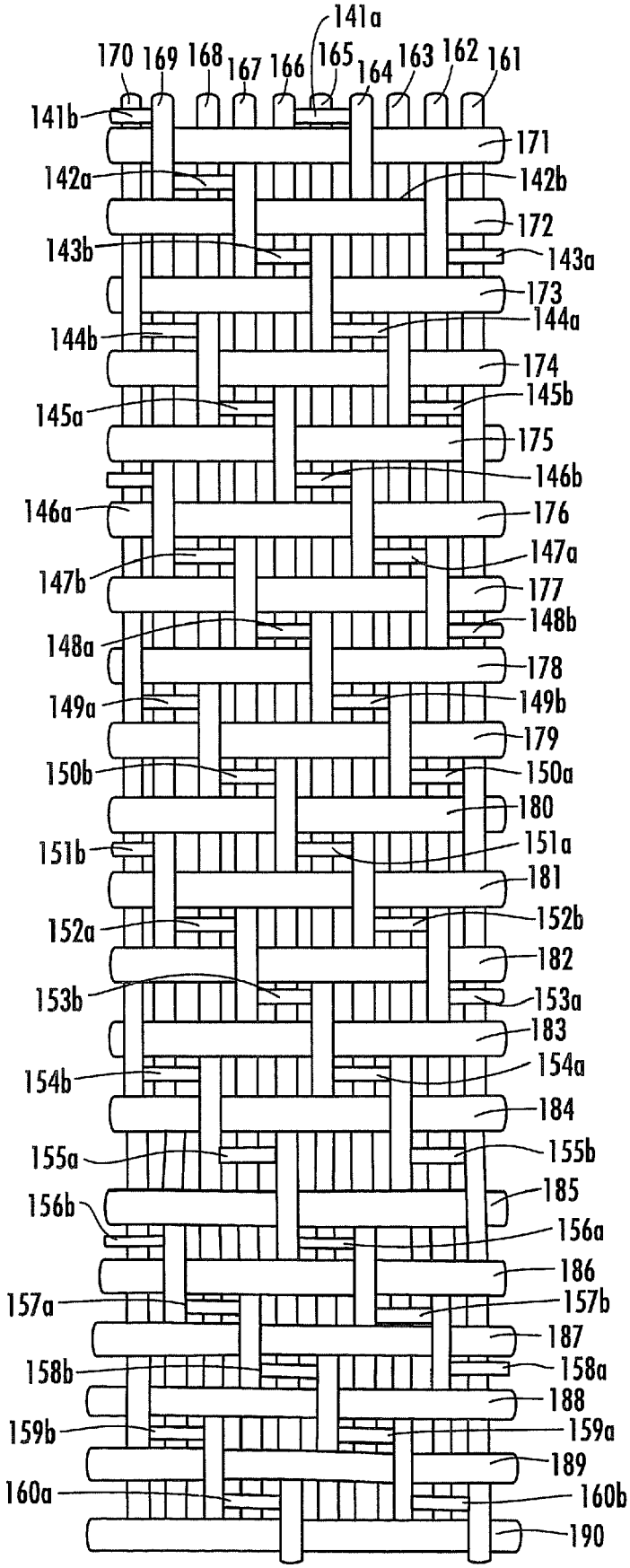
FIG. 2 is a bottom view of the bottom layer of the fabric of FIG. 1.

Tuning now to FIG. 2, the bottom surface of the fabric is shown therein. The bottom MD yarns 161-170 interweave with the bottom CMD yarns 171-190 in an "over 4/under 1" pattern" (note that FIG. 2 is a bottom view of the fabric 100 and is opposite the view of FIG. 1, so the description of the bottom MD yarns passing "over 4" bottom CMD yarns is consistent with the "over" and "under" conventions adopted with respect to FIGS. 1 and 3A-3E rather than the view seen in FIG. 2). For example, bottom MD yarn 161 passes over bottom CMD yarns 171-174, under bottom CMD yarn 175, over bottom CMD yarns 176-179, under bottom CMD yarn 180, and so on until terminating by passing under bottom CMD yarn 190. The remaining bottom MD yarns follow a similar pattern, with each bottom MD yarn being offset from its adjacent bottom MD yarns by two bottom CMD yarns. For example, bottom MD yarn 162 passes below bottom CMD yarn 177, which is offset from bottom CMD yarn 175 that bottom MD yarn 161 passes under by two bottom CMD yarns. This pattern, in which the bottom CMD yarns form 4-yarn "floats" under the bottom MD yarns, is repeated throughout the repeat unit.

Also, the binding portion of each of the stitching yarns 141*a*, 141*b*-160*a*, 160*b* is stitched below one bottom MD yarn, with the stitching yarns of a pair stitching below bottom MD yarns that are separated by five bottom MD yarns. For example, as shown in FIG. 3A, stitching yarn 141*a* passes below bottom MD yarn 165, and stitching yarn 141*b* passes under bottom MD yarn 170. Adjacent pairs of stitching yarns 141*a*, 141*b*-160*a*, 160*b* are offset from each other by two bottom MD yarns.

A fabric having a weave pattern such as that shown in FIGS. 1-3E, in particular one with an alternating pattern of two top CMD yarns, then one top CMD yarn, between pairs of CMD stitching yarns, can provide additional fiber support for improved retention of fibers and sheet quality in papermaking compared to some prior fabrics, and can do so without increasing manufacturing costs. In essence, there are five effective top CMD yarns (either actual top CMD yarns or "composite" CMD yarns formed by the fiber support portions of a pair of stitching yarns) for every two bottom CMD yarns, which can provide the aforementioned fiber support.

Figure 4:
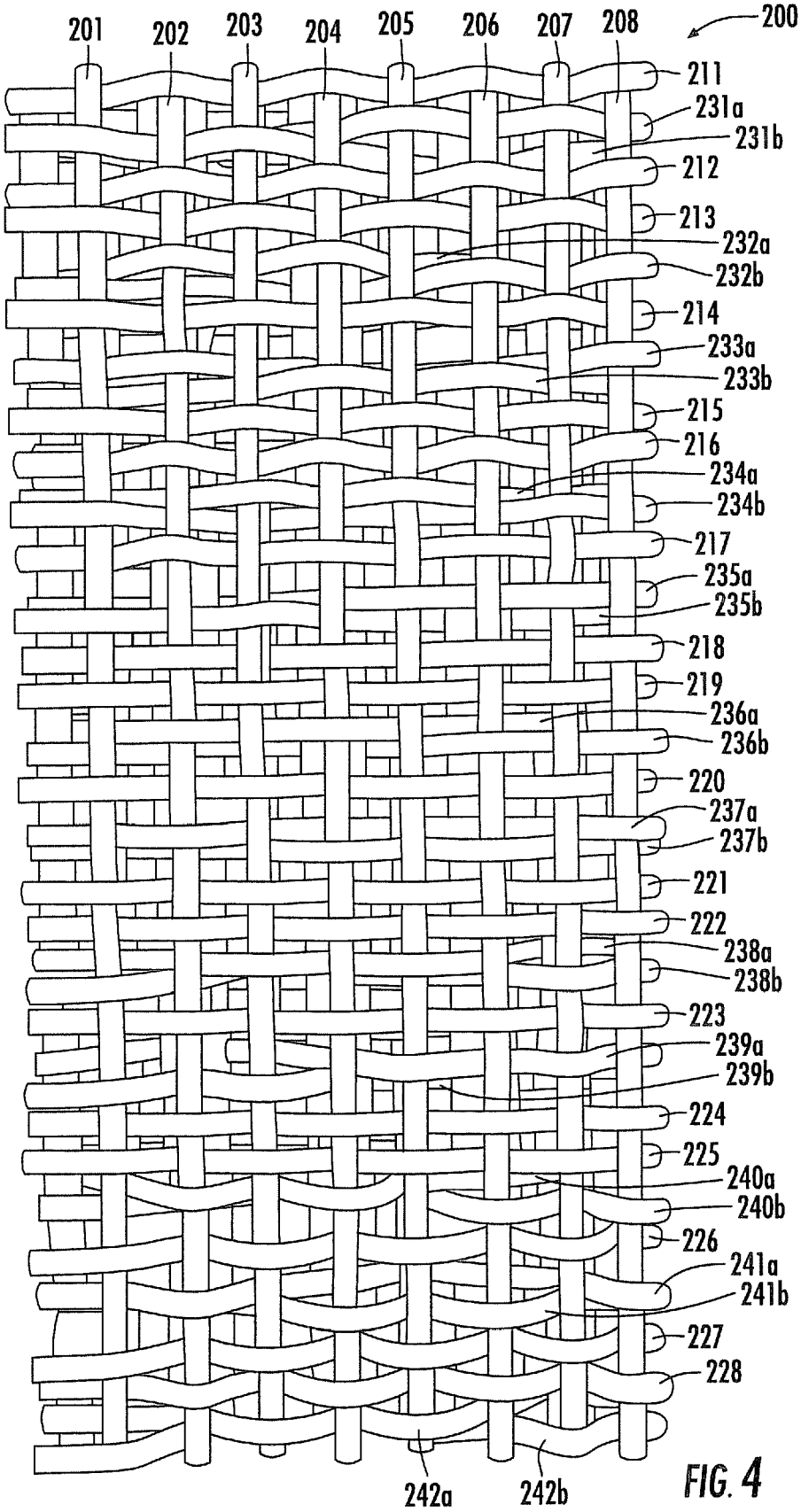
FIG. 4 is a top view of the top layer of a repeat unit of a fabric according to additional embodiments of the present invention.
Figure 5:
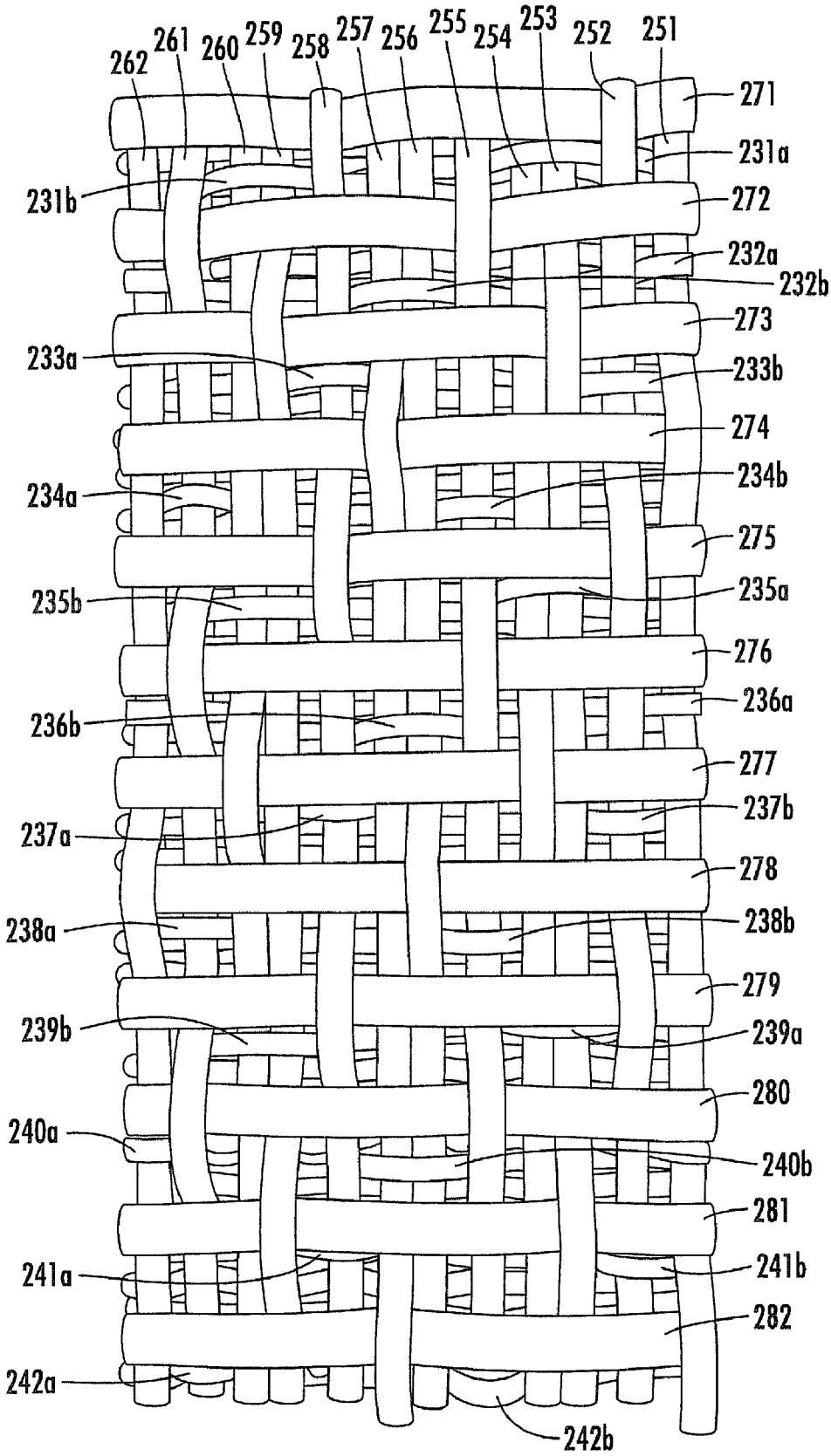
FIG. 5 is a bottom view of the bottom layer of the fabric of FIG. 4.

A repeat unit of another embodiment of a fabric that utilizes the 5:2 effective top CMD yarn/bottom CMD yarn ratio is shown in FIGS. 4 and 5 and is designated broadly at 200. The fabric 200 includes eight top yarns 201-208, eighteen top CMD yarns 211-228, twelve bottom MD yarns 251-262, twelve bottom CMD yarns 271-282, and twelve pairs of stitching yarns 231*a*, 231*b*-242*a*, 242*b*. The interweaving of these yarns is described below.

Turning first to FIG. 4, the top surface of the fabric 200 is shown therein. The top CMD yarns 211-228 are arranged in the same alternating pattern described above for the fabric 100, in which two top CMD yarns are positioned between pairs of stitching yarns, then a single top CMD yarn is positioned between pairs of stitching yarns. As exemplified in FIG. 4, top CMD yarns 212 and 213 are positioned between stitching yarn pairs 231*a*, 231*b* and 232*a*, 232*b*, then top CMD yarn 214 is positioned between stitching yarn pairs 232*a*, 232*b* and 233*a*, 233*b*. This pattern of "stitching yarn pair/two top CMD yarns/stitching yarn pair/one top CMD yarn" continues throughout the repeat unit.

As is the case for the fabric 100, each of the top CMD yarns 211-228 interweaves with the top MD yarns in an "over 1/under 1" sequence. When two top CMD yarns are positioned between a pair of stitching yarns, they pass over alternating top MD yarns; when instead a single top CMD is positioned between two stitching yarn pairs, it passes over the same top MD yarns as the adjacent top CMD yarns on either side. This pattern is shown in FIG. 4, wherein top CMD yarn 211 is shown passing over top MD yarns 202, 204, 206 and 208, and top CMD yarn 212 is also shown passing over top MD yarns 202, 204, 206 and 208, but top CMD yarn 213 passes over top MD yarns 201, 203, 205 and 207.

As in the fabric 100, in its fiber support portion each stitching yarn 231*a*, 231*b*-242*a*, 242*b* passes over top MD yarns that the adjacent top CMD yarns pass beneath and under the top MD yarns that the adjacent top CMD yarns pass over. For example, and as shown in FIG. 4, the fiber support portion of stitching yarn 231*a* passes over top MD yarns 205 and 207 while passing under top MD yarn 206, and stitching yarn 231*b* passes over top MD yarns 201 and 203 while passing below top MD yarn 202. Both stitching yarns 231*a*, 231*b* pass below the transitional top MD yarns 204, 208. As discussed above, adjacent top CMD yarn 211 passes over top MD yarns 202, 204, 206 and 208. The remaining stitching yarn pairs weave in a similar maimer, although they may be offset from adjacent stitching yarn pairs by one or more top MD yarns. In this maimer, the stitching yarns 231*a*, 231*b*-242*a*, 242*b* and the top CMD yarns 211-228 form a plain weave pattern with the top MD yarns 201-208 (see FIG. 4).

Turning now to FIG. 5, the bottom MD yarns 251-262 are interwoven with the bottom CMD yarns 271-282 such that each bottom MD yarn forms either one, two or three knuckles below bottom CMD yarns. For example, bottom MD yarn 251 follows an "over 3/under 1/over 7/under 1" sequence in forming two bottom MD knuckles. Bottom MD yarns 253, 257 and 259 follow similar sequences, with bottom MD yarns 253, 259 being offset by one bottom CMD yarn. Bottom MD yarns 252, 255, 258 and 261 each follow an "over 3/under 1/over 3/under 1/over 3/under 1" pattern to form three bottom MD knuckles under the bottom CMD yarns. Bottom MD yarns 254, 256, 260 and 262 each follow an "over 11/under 1" pattern with the bottom CMD yarns to form one bottom MD knuckle under the bottom CMD yarns.

Referring again to FIG. 5, each of the stitching yarns 231*a*, 231*b*-242*a*, 242*b* stitches once underneath the bottom MD yarns. Depending on the stitching location, a stitching yarn may stitch under one bottom MD yarn (for example, stitching yarn 232*a* stitches underneath bottom MD yarn 251) or under two adjacent bottom MD yarns (for example, stitching yarn 231*a* stitches underneath bottom MD yarns 253, 254). In the illustrated embodiment, the stitching yarns of a pair either both stitch under either one bottom MD yarn or both stitch under two bottom MD yarns.

Figure 6:
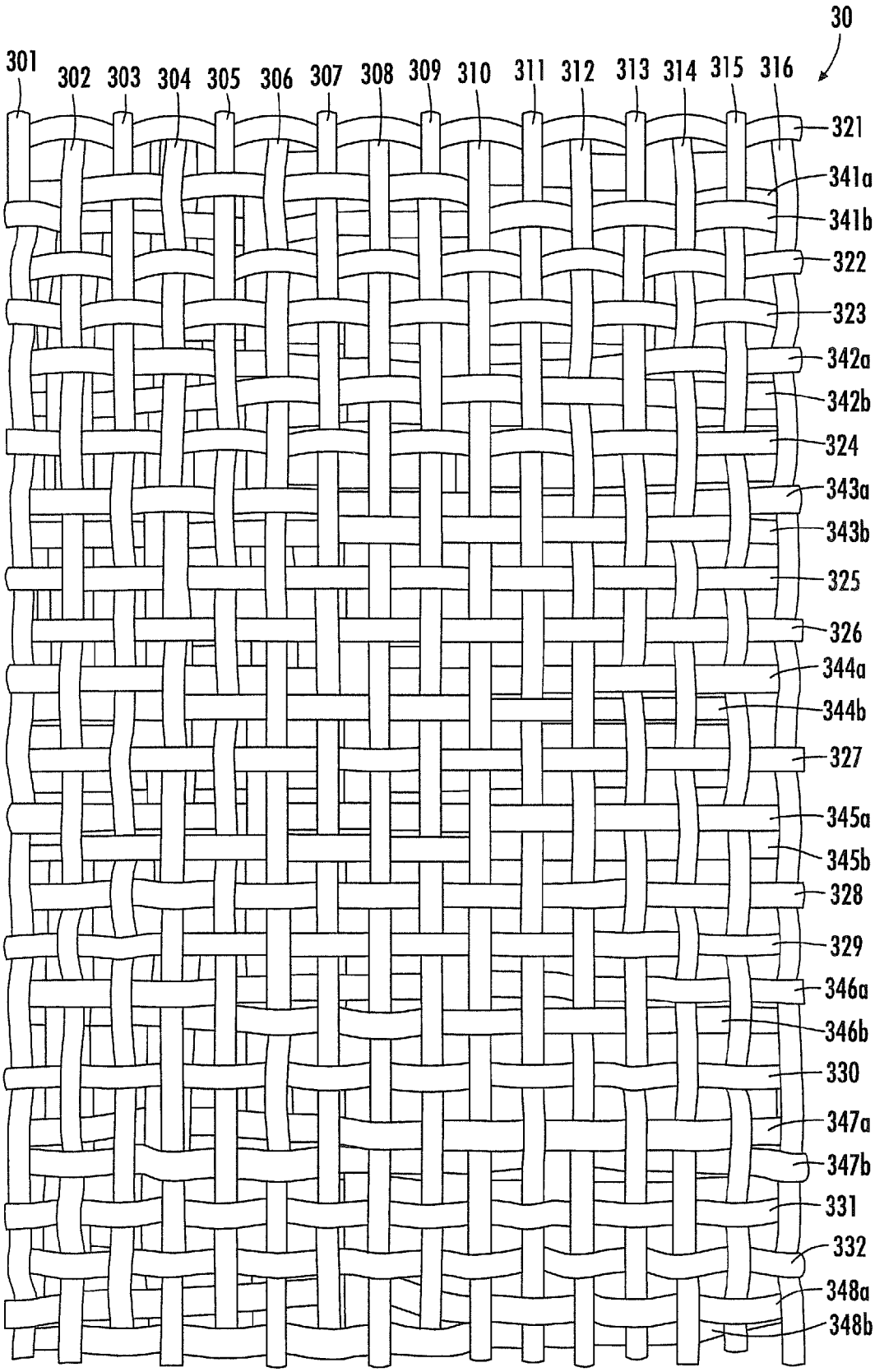
FIG. 6 is a top view of the top layer of a repeat unit of a fabric according to embodiments of the present invention.
Figure 7:
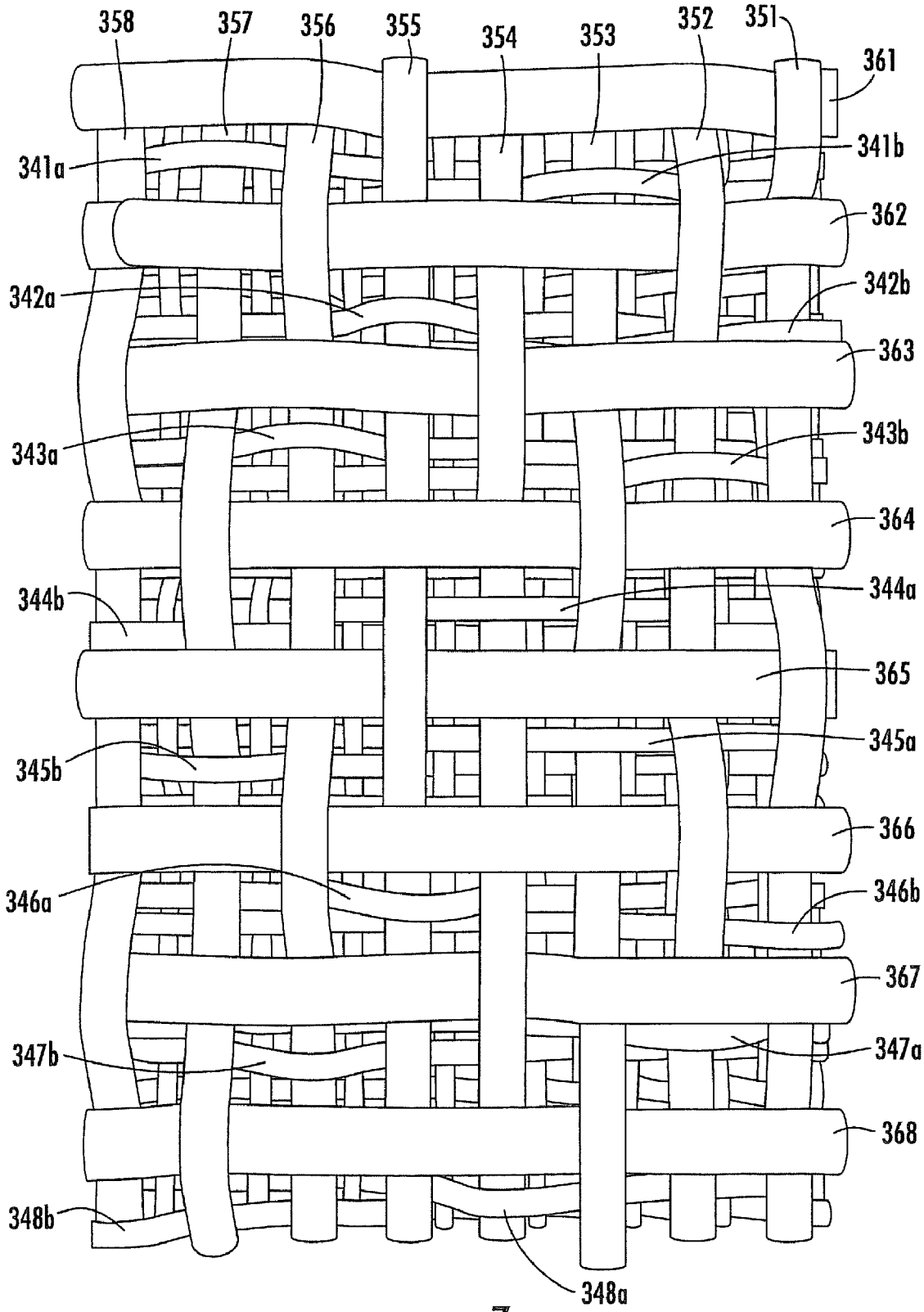
FIG. 7 is a bottom view of the bottom layer of the fabric of FIG. 6.

A repeat unit of another fabric according to embodiments of the present invention is illustrated in FIGS. 6 and 7 and broadly designated at 300. The fabric 300 includes sixteen top yarns 301-316, twelve top CMD yarns 321-332, eight bottom MD yarns 351-358, eight bottom CMD yarns 361-368, and eight pairs of stitching yarns 341*a*, 341*b*-348*a*, 348*b*. The interweaving of these yarns is described below.

Turning first to FIG. 6, the top surface of the fabric 300 is shown therein. The top CMD yarns 321-332 are arranged in the same alternating pattern described above for the fabrics 100 and 200, in which two top CMD yarns are positioned between pairs of stitching yarns, then a single top CMD yarn is positioned between pairs of stitching yarns. As exemplified in FIG. 6, top CMD yarns 322 and 323 are positioned between stitching yarn pairs 341*a*, 341*b* and 342*a*, 342*b*, then top CMD yarn 324 is positioned between stitching yarn pairs 342*a*, 342*b* and 343*a*, 343*b*. This pattern of "stitching yarn pair/two top CMD yarns/stitching yarn pair/one top CMD yarn" continues throughout the repeat unit.

As is the case for the fabrics 100 and 200, each of the top CMD yarns 321-332 interweaves with the top MD yarns in an "over 1/under 1" sequence. When two top CMD yarns are positioned between a pair of stitching yarns, they pass over alternating top MD yarns; when instead a single top CMD is positioned between two stitching yarn pairs, it passes over the same top MD yarns as the adjacent top CMD yarns on either side. This pattern is shown in FIG. 6, wherein top CMD yarn 321 is shown passing over top MD yarns 302, 304, 306, 308, 310, 312, 314 and 316, and top CMD yarn 322 is also shown passing over top MD yarns 302, 304, 306, 308, 310, 312, 314 and 316, but top CMD yarn 323 passes over top MD yarns 301, 303, 305, 307, 309, 311, 313 and 315.

As in the fabric 100, in its fiber support portion each stitching yarn 341*a*, 341*b*-348*a*, 348*b* passes over top MD yarns that the adjacent top CMD yarns pass beneath and under the top MD yarns that the adjacent top CMD yarns pass over. For example, and as shown in FIG. 6, the fiber support portion of stitching yarn 341*a* passes over top MD yarns 303, 305, 307 and 309 while passing under top MD yarns 304, 306 and 308, and stitching yarn 341*b* passes over top MD yarns 311, 313, 315 and 301 while passing below top MD yarns 312, 314 and 316. Both stitching yarns 341*a*, 341*b* pass below the transitional top MD yarns 302, 310. As discussed above, adjacent top CMD yarns 321 and 322 pass over top MD yarns 302, 304, 306, 308, 310, 312, 314 and 316. The remaining stitching yarn pairs weave in a similar manner, although they may be offset from adjacent stitching yarn pairs by one or more top MD yarns. In this manner, the stitching yarns 341*a*, 341*b*-348*a*, 348*b* and the top CMD yarns 321-332 form a plain weave pattern with the top MD yarns 301-316 (see FIG. 6).

Turning now to FIG. 7, the bottom MD yarns 351-358 are interwoven with the bottom CMD yarns 361-368 in an "under 1/over 3" sequence. For example, the bottom MD yarn 351 passes under bottom CMD yarn 361, over bottom CMD yarns 362-364, under bottom CMD yarn 365, and over bottom CMD yarns 366-368. The remaining bottom MD yarns follow the same weaving pattern, but are offset from the adjacent bottom MD yarns such that the knuckles form a 4-harness satin pattern.

Each of the stitching yarns 341*a*, 341*b*-348*a*, 348*b* stitches beneath one bottom MD yarn; the bottom MD yarns being stitched underneath are separated from each other by three bottom MD yarns. For example, stitching yarn 341*a* stitches under bottom MD yarn 357, whereas stitching yarn 341*b* stitches under bottom MD yarn 353. The stitching knuckles formed under bottom MD yarns are arranged in a 4-harness satin pattern.

Figure 8:
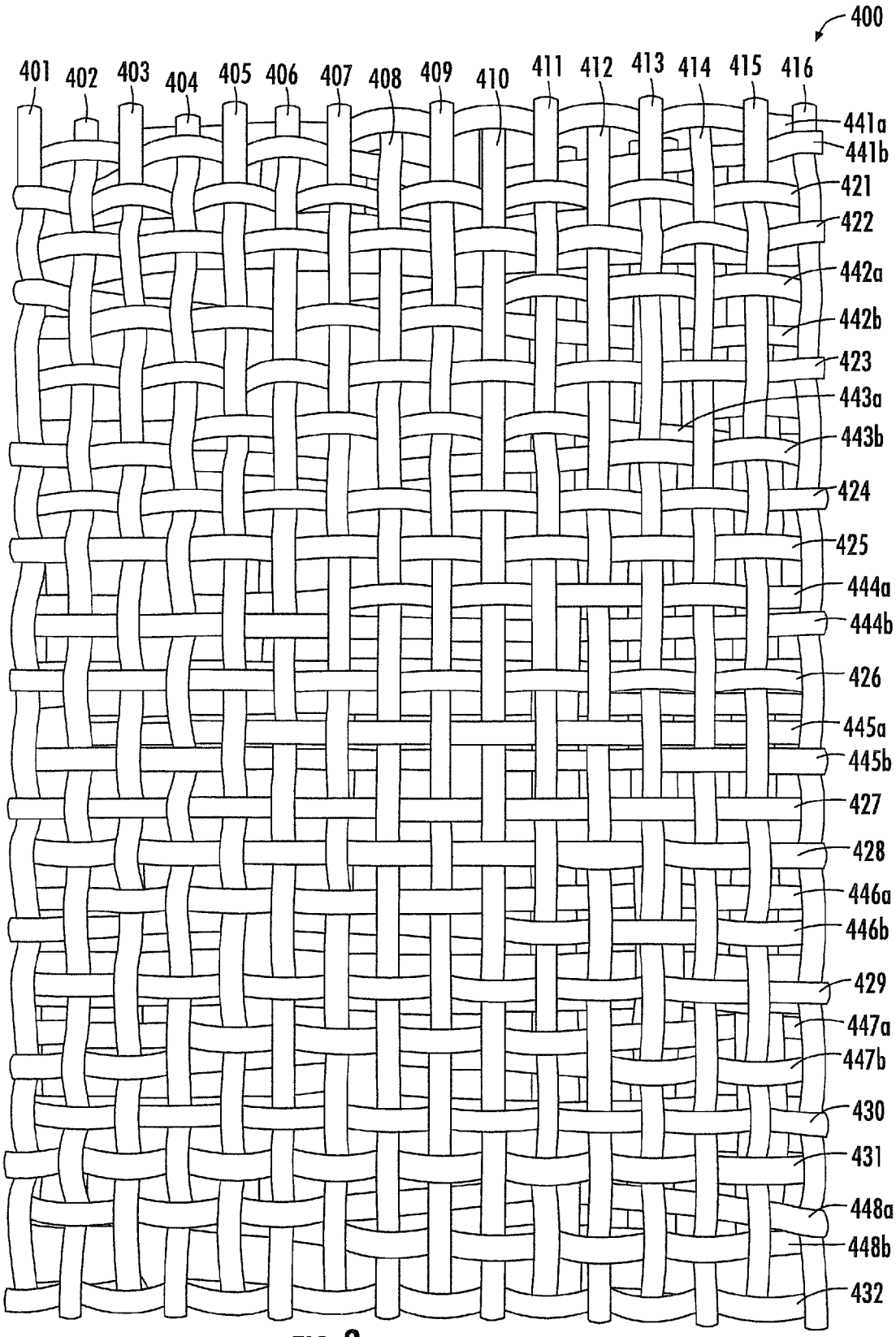
FIG. 8 is a top view of the top layer of a repeat unit of a fabric according to additional embodiments of the present invention.
Figure 9:
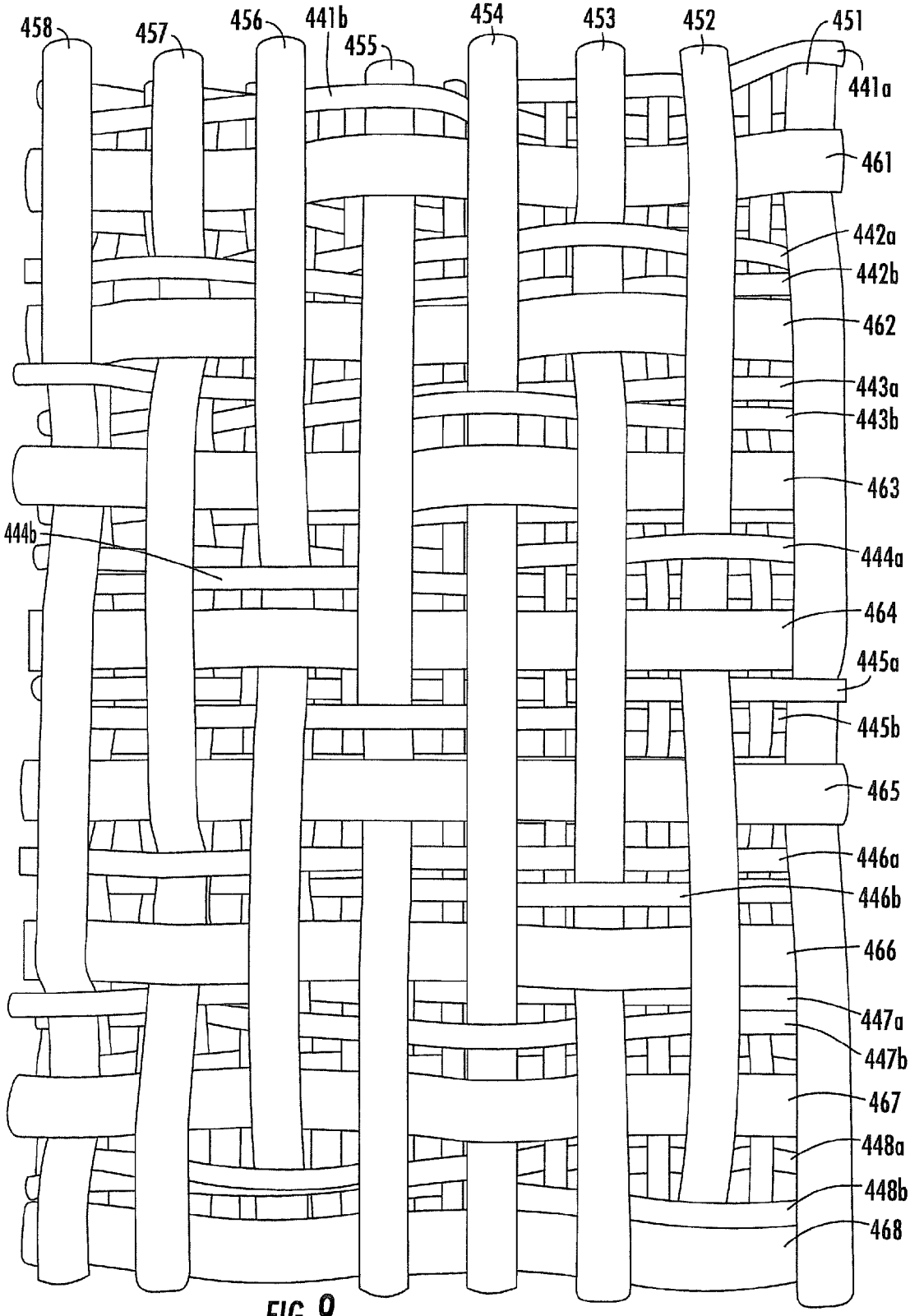
FIG. 9 is a bottom view of the bottom layer of the fabric of FIG. 8.

A repeat unit of another fabric according to embodiments of the present invention is illustrated in FIGS. 8 and 9 and broadly designated at 400. The fabric 400 includes sixteen top yarns 401-416, twelve top CMD yarns 421-432, eight bottom MD yarns 451-458, eight bottom CMD yarns 461-468, and eight pairs of stitching yarns 441*a*, 441*b*-448*a*, 448*b*. As can be seen in FIG. 8, the interweaving of the top MD yarns 401-416, the top CMD yarns 421-432, and the stitching yarns is virtually identical to that of the fabric 300. However, as can be seen in FIG. 9, the bottom surface of the fabric 400 differs in that the bottom MD yarns 451-458 weave with the bottom CMD yarns 461-468 in an "over 1/under 3/over 1/under 3" sequence (i.e., the bottom MD yarns form 3-yarn "floats" under the bottom CMD yarns). For example, the bottom MD yarn 451 passes over bottom CMD yarn 461, under bottom CMD yarns 462-464, over bottom CMD yarn 465, and under bottom CMD yarns 466-468. The bottom knuckles formed by the bottom CMD yarns 461-468 form a 4-harness satin pattern. The stitching yarns 441*a*, 441*b*-448*a*, 448*b* stitch under a bottom MD yarn adjacent to a bottom CMD yarn. For example, bottom CMD yarn 461 forms knuckles under bottom MD yarns 451 and 455, as do adjacent stitching yarns 441*a*, 441*b*. This proximity of stitching yarn knuckles to bottom CMD yarn knuckles can help to protect the stitching yarns from wear.

Each of these fabrics can exhibit improved fiber support (as measured by Beran's Fiber Support Index) and permeability over similar fabrics. Also, manufacturing costs can be reduced over fabrics that have a higher density of stitching yarn pairs.

The form of the yarns utilized in fabrics of the present invention can vary, depending upon the desired properties of the final papermaker's fabric. For example, the yarns may be monofilament yarns, flattened monofilament yarns as described above, multifilament yarns, twisted multifilament or monofilament yarns, spun yarns, or any combination thereof. However, in some embodiments, monofilaments are preferred. Also, the materials comprising yarns employed in the fabric of the present invention may be those commonly used in papermaker's fabric. For example, the yarns may be formed of polyester, polyamide (nylon), polypropylene, aramid, or the like. In addition, these polymers may contain additives or may be blended with other polymers to impart special properties to the monofilaments, such as improved contamination, stretch, abrasion and/or chemical resistance, to enhance forming fabric performance. The skilled artisan should select a yarn material according to the particular application of the final fabric. In particular, round monofilament yarns formed of polyester or polyamide may be suitable, and, as noted, the use of monofilament yarns as bottom MD yarns may be particularly suitable.

Those skilled in this art will appreciate that yarns of different sizes may be employed in fabric embodiments of the present invention. As noted above, in embodiments that include both top and bottom MD yarns, the top MD yarns may be of a smaller diameter than the bottom MD yarns. For example, the top MD yarns, top CMD yarns, and stitching yarns may have a diameter of between about 0.10 and 0.20 mm, the bottom MD yarns may have a diameter of between about 0.12 and 0.34 mm, and the bottom CMD yarns may have a diameter of between about 0.20 and 0.30 mm. The mesh of fabrics according to embodiments of the present invention may also vary. For example, the mesh of the top surface may vary between about 20×20 to 40×50 (epcm to ppcm), and the total mesh may vary between about 40×35 to 90×90.

In addition, the numbers of different types of yarns relative to other types of yarns may vary. For example, in some of the embodiments shown, the ratio of top MD yarns to bottom MD yarns is 1:1; in others, the ratio of top MD yarns to bottom MD yarns is 2:1 2:3, but other ratios may also be employed. In some embodiments, the number of "effective" top CMD yarns (i.e., the number of top CMD yarns plus the number of CMD stitching yarn pairs) is 5:2; however, other ratios, such as 1:1 and 2:1, may also be employed.

Finally, although each of the embodiments include a plain weave top surface, other embodiments may include a top surface having a different weave pattern, including twill, satin, or the like. In addition, the long MD float bottom surfaces of the fabrics may take other weave patterns, including satin, twill or the like.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paper stock is well understood by those of skill in the art, additional details regarding this aspect of the present invention need not be provided herein.

The foregoing embodiments are illustrative of the present invention, and are not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A papermaker's fabric comprising a series of repeat units, each of the repeat units comprising:

a set of top machine direction (MD) yarns;

a set of top cross-machine direction (CMD) yarns interwoven with the top MD yarns to form a top fabric layer;

a set of bottom MD yarns;

a set of bottom CMD yarns interwoven with the bottom MD yarns to form a bottom fabric layer; and a set of CMD stitching yarns interwoven with the top and bottom CMD yarns to bind the top and bottom fabric layers together;

wherein the stitching yarns are arranged in pairs; and wherein the top CMD yarns are arranged in an alternating pattern in which first (a) a single top CMD yarn is positioned between adjacent pairs of stitching yarns, then (b) two top CMD yarns are positioned between adjacent pairs of stitching yarns.

2. The papermaker's fabric defined in claim 1, wherein the top MD yarns, the top CMD yarns, and portions of the stitching yarns interweave to form a plain weave papermaking surface on the top fabric layer.

3. The papermaker's fabric defined in claim 1, wherein one of the pair of stitching yarns forms a first number of knuckles over the top MD yarns, and the other of the pair of stitching yarns forms a second number of knuckles over the top MD yarns, and the second number is the same as the first number.

4. The papermaker's fabric defined in claim 1, wherein one of the pair of stitching yarns forms a first number of knuckles over the top MD yarns, and the other of the pair of stitching yarns forms a second number of knuckles over the top MD yarns, and the second number is greater than the first number.

5. The papermaker's fabric defined in claim 1, wherein the bottom CMD yarns form floats under the bottom MD yarns.

6. The papermaker's fabric defined in claim 5, wherein the stitching yarns form knuckles under the bottom MD yarns between portions of adjacent floats formed by adjacent bottom CMD yarns.

7. The papermaker's fabric defined in claim 1, wherein the bottom CMD yarns form knuckles under the bottom MD yarns.

8. The papermaker's fabric defined in claim 7, wherein the stitching yarns form knuckles immediately adjacent to knuckles formed by bottom CMD yarns.

9. The papermaker's fabric defined in claim 2, wherein the ratio of top CMD yarns and stitching yarn pairs to bottom CMD yarns is 5:2.

10. A papermaker's fabric comprising a series of repeat units, each of the repeat units comprising:

a set of top machine direction (MD) yarns;

a set of top cross-machine direction (CMD) yarns interwoven with the top MD yarns to form a top fabric layer;

a set of bottom MD yarns;

a set of bottom CMD yarns interwoven with the bottom MD yarns to form a bottom fabric layer; and a set of CMD stitching yarns interwoven with the top and bottom CMD yarns to bind the top and bottom fabric layers together;

wherein the stitching yarns are arranged in pairs; and wherein the top CMD yarns are arranged in an alternating pattern in which first (a) a single top CMD yarn is positioned between adjacent pairs of stitching yarns, then (b) two top CMD yarns are positioned between adjacent pairs of stitching yarns;

wherein the top MD yarns, the top CMD yarns, and portions of the stitching yarns interweave to form a plain weave papermaking surface on the top fabric layer; and wherein the bottom CMD yarns form floats under the bottom MD yarns.

11. The papermaker's fabric defined in claim 10, wherein one of the pair of stitching yarns forms a first number of knuckles over the top MD yarns, and the other of the pair of stitching yarns forms a second number of knuckles over the top MD yarns, and the second number is the same as the first number.

12. The papermaker's fabric defined in claim 10, wherein one of the pair of stitching yarns forms a first number of knuckles over the top MD yarns, and the other of the pair of stitching yarns forms a second number of knuckles over the top MD yarns, and the second number is greater than the first number.

13. The papermaker's fabric defined in claim 10, wherein the stitching yarns form knuckles under the bottom MD yarns between portions of adjacent floats formed by adjacent bottom CMD yarns.

14. The papermaker's fabric defined in claim 10, wherein the ratio of top CMD yarns and stitching yarn pairs to bottom CMD yarns is 5:2.

15. A papermaker's fabric comprising a series of repeat units, each of the repeat units comprising:

a set of top machine direction (MD) yarns;

a set of top cross-machine direction (CMD) yarns interwoven with the top MD yarns to form a top fabric layer;

a set of bottom MD yarns;

a set of bottom CMD yarns interwoven with the bottom MD yarns to form a bottom fabric layer; and a set of CMD stitching yarns interwoven with the top and bottom CMD yarns to bind the top and bottom fabric layers together;

wherein the stitching yarns are arranged in pairs; and wherein the top CMD yarns are arranged in an alternating pattern in which first (a) a single top CMD yarn is positioned between adjacent pairs of stitching yarns, then (b) two top CMD yarns are positioned between adjacent pairs of stitching yarns;

wherein the top MD yarns, the top CMD yarns, and portions of the stitching yarns interweave to form a plain weave papermaking surface on the top fabric layer; and wherein the bottom CMD yarns form knuckles under the bottom MD yarns.

16. The papermaker's fabric defined in claim 15, wherein one of the pair of stitching yarns forms a first number of knuckles over the top MD yarns, and the other of the pair of stitching yarns forms a second number of knuckles over the top MD yarns, and the second number is the same as the first number.

17. The papermaker's fabric defined in claim 15, wherein the stitching yarns form knuckles immediately adjacent to knuckles formed by bottom CMD yarns.

18. The papermaker's fabric defined in claim 15, wherein the ratio of top CMD yarns and stitching yarn pairs to bottom CMD yarns is 5:2.

19. A papermaker's fabric comprising a series of repeat units, each of the repeat units comprising:

a set of top machine direction (MD) yarns;

a set of top cross-machine direction (CMD) yarns interwoven with the top MD yarns to form a top fabric layer;

a set of bottom MD yarns;

a set of bottom CMD yarns interwoven with the bottom MD yarns to form a bottom fabric layer; and a set of CMD stitching yarns interwoven with the top and bottom CMD yarns to bind the top and bottom fabric layers together;

wherein the stitching yarns are arranged in pairs; and wherein the top CMD yarns are arranged in an alternating pattern in which first (a) a single top CMD yarn is positioned between adjacent pairs of stitching yarns, then (b) two top CMD yarns are positioned between adjacent pairs of stitching yarns;

wherein the ratio of top CMD yarns and stitching yarn pairs to bottom CMD yarns is 5:2.

20. The papermaker's fabric defined in claim 19, wherein one of the pair of stitching yarns forms a first number of knuckles over the top MD yarns, and the other of the pair of stitching yarns forms a second number of knuckles over the top MD yarns, and the second number is the same as the first number.

21. The papermaker's fabric defined in claim 19, wherein one of the pair of stitching yarns forms a first number of knuckles over the top MD yarns, and the other of the pair of stitching yarns forms a second number of knuckles over the top MD yarns, and the second number is greater than the first number.

22. The papermaker's fabric defined in claim 19, wherein the bottom CMD yarns form floats under the bottom MD yarns.

23. The papermaker's fabric defined in claim 22, wherein the stitching yarns form knuckles under the bottom MD yarns between portions of adjacent floats formed by adjacent bottom CMD yarns.

24. The papermaker's fabric defined in claim 19, wherein the bottom CMD yarns form knuckles under the bottom MD yarns.

25. The papermaker's fabric defined in claim 24, wherein the stitching yarns form knuckles immediately adjacent to knuckles formed by bottom CMD yarns.

* * * * *

UNITED STATES PATENT AND TRADEMARK OFFICE

CERTIFICATE OF CORRECTION

PATENT NO. : 7,766,053 B2
APPLICATION NO. : 12/409814
DATED : August 3, 2010
INVENTOR(S) : Barratte et al.

It is certified that error appears in the above-identified patent and that said Letters Patent is hereby corrected as shown below:

On Title Page:
Item (12): Please correct "Barratte" to read -- Barratte et al. --
Item (75) Inventor: Please correct by adding -- Kevin John Ward, Coldbrook, CANADA --

Signed and Sealed this
Twenty-second Day of February, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,766,053 B2
APPLICATION NO. : 12/409814
DATED : August 3, 2010
INVENTOR(S) : Barratte et al.

It is certified that error appears in the above-identified patent and that said Letters Patent is hereby corrected as shown below:

On the Title Page:
Item (57) Abstract, Line 7: Please correct "bottom CMD yarns"
to read -- bottom MD yarns --

In the Patent:
Column 3, Line 5: Please correct "bottom CMD yarns"
to read -- bottom MD yarns --
Line 19: Please correct "bottom CMD yarns"
to read -- bottom MD yarns --
Line 37: Please correct "bottom CMD yarns"
to read -- bottom MD yarns --
Line 55: Please correct "bottom CMD yarns"
to read -- bottom MD yarns --

Column 4, Line 3: Please correct "bottom CMD yarns"
to read -- bottom MD yarns --

In the Claims:
Column 10, Claim 1, Line 43: Please correct "bottom CMD yarns"
to read -- bottom MD yarns --

Column 11, Claim 10, Line 23: Please correct "bottom CMD yarns"
to read -- bottom MD yarns --

Claim 15, Line 64: Please correct "bottom CMD yarns"
to read -- bottom MD yarns --

Column 12, Claim 19, Line 32: Please correct "bottom CMD yarns"
to read -- bottom MD yarns --

Signed and Sealed this
Twentieth Day of March, 2012

David J. Kappos

David J. Kappos
*Director of the United States Patent and Trademark Office*